US006842162B2

(12) United States Patent
Gariboldi et al.

(10) Patent No.: US 6,842,162 B2
(45) Date of Patent: Jan. 11, 2005

(54) LIQUID CRYSTAL DISPLAY MEMORY CONTROLLER USING FOLDED ADDRESSING

(75) Inventors: Roberto Gariboldi, Lachiarella (IT); Riccardo Lavorerio, Broni (IT); Leonardo Sala, Pont S. Martin (IT); Giovanni Nidasio, Rosate (IT)

(73) Assignees: STMicroelectronics S.r.l., Agrate Brianza (IT); TECDIS S.p.A., Chantillon (IT)

( * ) Notice: Subject to any disclaimer, the term of this patent is extended or adjusted under 35 U.S.C. 154(b) by 684 days.

(21) Appl. No.: 09/934,079

(22) Filed: Aug. 20, 2001

(65) Prior Publication Data

US 2002/0057240 A1 May 16, 2002

(30) Foreign Application Priority Data

Aug. 22, 2000 (EP) ..... 00830587

(51) Int. Cl.[7] ..... G09G 3/36

(52) U.S. Cl. ..... 345/87; 345/98; 345/100; 345/559

(58) Field of Search ..... 345/98, 100, 87, 345/55, 530, 536, 537, 557, 559, 60, 88, 76

(56) References Cited

U.S. PATENT DOCUMENTS 4,737,782 A 4/1988 Fukuma et al. ..... 340/765
5,627,559 A * 5/1997 Tsuboyama et al. ..... 345/97
5,748,175 A * 5/1998 Shimada et al. ..... 345/660
5,844,539 A * 12/1998 Kitagawa ..... 345/100
6,236,388 B1 * 5/2001 Iida et al. ..... 345/698

* cited by examiner

*Primary Examiner*—Dennis-Doon Chow
(74) *Attorney, Agent, or Firm*—Lisa K. Jorgenson; E. Russell Tarleton; Seed IP Law Group PLLC

(57) ABSTRACT

A new memory controller for use in a display, such as a liquid crystal display of the type comprising a set of first drivers, a set of second drivers, a portion of which can be converted to the first drivers, and a RAM memory structured to accept data at an input and output the data to the sets of first and second drivers when a master clock signal is received at the RAM memory. The memory controller includes a clock signal generator structured to generate the master clock signal; and a control signal generator circuit structured to generate control signals for the RAM memory and the sets of first and second drivers. An important advantage of this memory controller is that it includes a set of auxiliary registers structured to temporarily store a first portion of the data received from the RAM memory after receiving the slave clock cycle, and the set of auxiliary registers structured to output the first portion of data into the portion of the second drivers converted to the set of first drivers after receiving the master clock signal. A method is also disclosed that uses the above structure in order to perform the steps of using a folded memory as a way to increase the utilization rate of memory within the display controller.

18 Claims, 8 Drawing Sheets

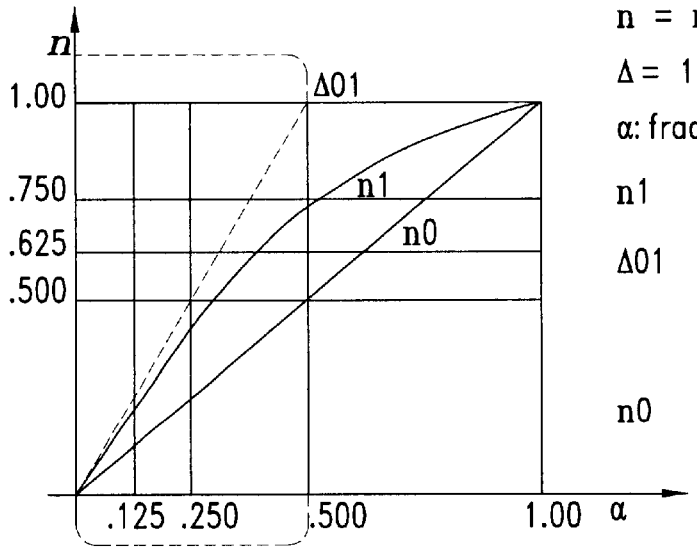

$n = n(\alpha) = \alpha + (1-\alpha)\alpha\ (NR/NC)$ $\Delta = 1 + (1-2\alpha)\ (NR/NC)$ α: fraction of NR used as columns n1 n function @Nr/Nc=1

Δ01 :derivative function of n @Nr/Nc=1@alfa=0 n n0 n function without folding

*Fig. 9A*

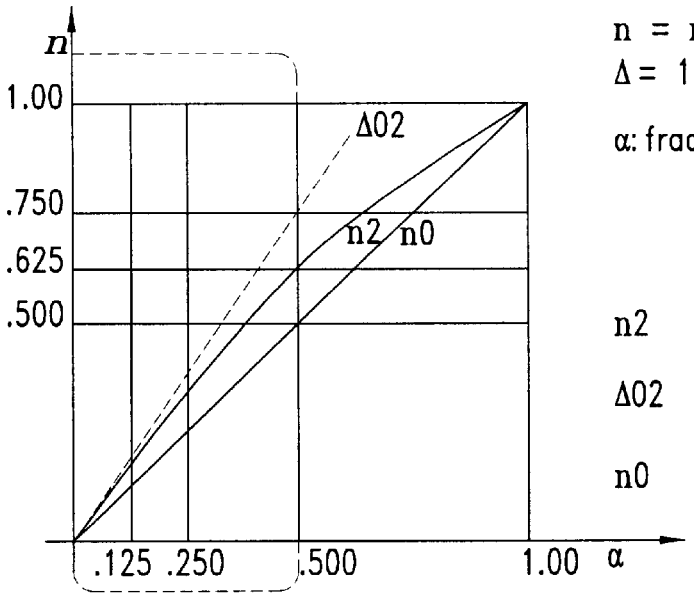

$n = n(\alpha) = \alpha + (1-\alpha)\alpha\ (NR/NC)$ $\Delta = 1 + (1-2\alpha)\ (NR/NC)$ α: fraction of NR used as columns n2 n function @Nr/Nc=.5

Δ02 :derivative function of n @Nr/Nc=.5@alfa=0 n0 n function without folding

*Fig. 9B*

LIQUID CRYSTAL DISPLAY MEMORY CONTROLLER USING FOLDED ADDRESSING

BACKGROUND OF THE INVENTION

1. Field of the Invention

The present invention relates to a memory controller for driving liquid crystal display devices, and, in particular, to a controller that achieves better memory utilization while simultaneously reducing the multiplex ratio of programmable multiplex ratio solutions of the memory device.

2. Description of the Related Art

In driving a liquid crystal display (LCD), a multiplex method is typically used where the display dots of the LCD are divided into a number of groups. Each group is provided with a common electrode, which is usually a row electrode. The common electrodes are sequentially selected to drive the dots of the group, thereby producing a pattern on the LCD. By using this multiplex method, problems with driving large LCDs are avoided, such as layout pattern limitations, among others.

A typical pulse waveform is illustrated in FIG. 1, which shows a driving pulse for eight rows, R0–R7. In a time period T0, for a mux M0, a pulse is sent to row R0, followed by a pulse sent to R1, etc., until all of the rows have been sequentially pulsed. The Mux M0/2 has a period twice as long as that of M0, and consequently, only the four rows, R0–R3 are strobed.

A typical LCD 10 is shown in FIG. 2 and comprises the following components. A RAM memory 12 is comprised of a number of memory cells, and stores data ultimately written to a display screen 30. The memory 12 is supplied by an interface logic 14, which itself receives instructions from a set of programming inputs. The interface logic 14 also provides signals to a control logic component 16, which has another input from a timing generator 18, itself receiving an input from an oscillator input.

Data from the memory 12 is presented to a series of NC data latches 20, where NC represents the number of columns displayed by the standard LCD display unit. Coupled to the set of data latches 20 is a set of shift registers 22, which also receives signals from the control logic 16. The set of shift registers 22 is NR bits wide, where NR indicates the number of rows in the standard LCD display unit.

Output from the data latches 20 is fed to a column driver circuit 24, and output from the shift registers 22 is fed to a row driver circuit 26. The row driver circuit 26 also receives a signal from the control logic 16. There are NC separate column drivers in the column driver circuit 24 and NR separate row drivers in the row driver circuit 26.

The column outputs from the column driver 24 and the row outputs from the row driver circuit 26 are sent to an LCD display unit 30 for display. These column and row outputs are the interface between the LCD 10 and the LCD display unit 30.

Shown in FIG. 3 is a graphical representation of the column driver circuit 24 and the row driver circuit 26. The row driver circuit 26 is shown at the top of the figure, while the column driver circuit 24 is shown at the bottom of the figure. A representation of the memory 12 resides in the middle portion of FIG. 3. The LDC display unit 30 has hundreds or thousands of dots, each dot energized or not depending on data located at a junction of one of the NR lines (rows) and one of the NC bits (columns).

Sometimes the size of the memory is determined by the maximum column size needed and the maximum number of rows needed. Occasionally, the user was forced to modify the size of the memory by the number of contact pads that were available on the chip, oftentimes leaving portions of the memory unused.

In many prior LCD controllers a feature is present that enables a programmable multiplex ratio in order to address many different LCD display types. Multiplex ratio modification affects the LCD controllers in several ways.

First, modifying the multiplex ratio requires that the voltage levels be adapted in order to guarantee optimum optical contrast at the minimum energy absorption. This reduces the overall power requirements of the LCD controllers because the voltage can be optimized so that a minimum of less energy is absorbed by the LCD display screen.

Second, the number of voltage pulses generated during the time of one frame, which is the time period needed to completely refresh all of the display rows, must be adapted accordingly. This preserves a quality image displayed on the LCD display.

Third, the time slice devoted to a single row increases linearly with the multiplex ratio reduction, and in an opposite way, decreases linearly with an increase in the multiplex ratio. This can be seen in reference to FIG. 1.

Fourth, if the multiplex ratio is reduced, fewer rows of the LCD display are used (also seen in FIG. 1) and the memory used to support more rows than are being used becomes partially unused.

The last point is measured by a relationship comparing memory that is used to a total amount of available memory:

$$\text{(used memory)}/\text{(available memory)} \quad (1)$$

As the multiplex ratio decreases, the amount of memory that is unused increases. Therefore, the above relation is reduced.

Alternatively, applications are sometimes required to combine a small number of rows (low multiplexing factor), thereby creating a large number of columns.

Prior LCD controllers, in an effort to provide flexibility for several multiplexing options, provided an amount of memory that is as large or larger than would be necessary for driving the display in any possible row/column configuration.

For example, as seen in FIG. 4, for a display having NC column drivers and NR row drivers, a memory 32 having NC1>NC bits per row may be used. The memory 32 of FIG. 4 is similar to the memory 12 shown in FIGS. 2 and 3, but has a larger number of columns per row. In this case, some of the row drivers could be converted into column drivers. Having more bits per row would increase the number of column drivers needed due to the increase in the size of the rows, while decreasing the number of row drivers needed, because with larger rows, fewer rows are needed for a given size memory. Therefore, some of the drivers that are normally used to drive rows can be converted into column drivers. With reference to FIG. 4, the number of row drivers 26*a* that are still used to drive rows in the row driving circuit 26, after conversion would be NR–(NC1–NC). The number of column drivers 26*b* in the "row" driving circuit 26 would be (NC1–NC), with one-half this amount being present on each side of the row drivers 26*a*.

A problem with the above scheme of the prior art is that the ratio in equation (1) will always be less than unity, and oftentimes much less.

An additional problem with the above scheme is that a different sized memory is used, that is the memory 32 has NC1 bits per row while the memory 12 has NC bits per row. It would be desirable to use a standard size memory for all different types of LCD controllers, rather than having to customize the memory for each display type.

The technical problem solved by the present invention is to provide a configurable, flexible LCD controller adaptable to a wide variety of multiplexing ratios while at the same time maximizing the use of available memory.

SUMMARY OF THE INVENTION

The embodiments of the present invention are directed to an architecture able to sequentially access two memory rows and to "fold" them by realigning them into a virtual longer single memory row. Various multiplexing ratios are available suitable for a variety of applications, all the while increasing the utilization of the memory. Additionally, this architecture uses minimal architecture and may be easily integrated with present circuits, and will not affect the system timing.

In accordance with one embodiment of the invention, a memory controller for a display is provided that includes an auxiliary set of registers configured to temporarily store a first portion of data received from a RAM memory after receiving a slave clock signal, the auxiliary registers further configured to output the first portion of data into a set of second drivers converted to a set of first drivers after receiving a master clock signal.

In accordance with another aspect of the foregoing embodiment, a memory controller for a display is provided that includes a set of first drivers; a set of second drivers, a portion of which can be converted to the first driver; a RAM memory structured to accept data at an input and output the data to the sets of first and second drivers when a master clock signal is received at the RAM memory; a clock signal generator structured to generate the master clock signal and a slave clock signal; a control signal generator circuit configured to generate control signals for the RAM memory and the sets of first and second drivers; and a set of auxiliary registers structured to temporarily store a first portion of the data received from the RAM memory after receiving the slave clock signal, and further structured to output the first portion of data into the portion of the second drivers converted to the first set of drivers after receiving the master clock signal.

In accordance with another embodiment of the invention, a method of using folded memory addressing in a liquid crystal display controller comprising a RAM memory, first and second sets of drivers, and a clock signal generator capable of generating master and slave clock signals is provided. The method includes converting a portion of the second set of drivers to the first set of drivers; after a storing clock signal is received storing data from the RAM memory into the first set of drivers and the converted set of second drivers; and transferring the data stored in the first and second converted set of drivers into the liquid crystal display and temporarily storing the data to be stored into the converted set of drivers into an auxiliary memory prior to transferring the data stored in the RAM memory into the first set of drivers.

BRIEF DESCRIPTION OF THE DRAWINGS

The characteristics and advantages of the device according to the invention will be seen from the description, following herein, of an embodiment given as an indication and not limiting with reference to the drawings attached.

The invention is described with reference to the following drawings, in which:

FIGS. 9*a* and 9*b* are charts showing percentage of useable memory used, for both folding and non-folding techniques.

DETAILED DESCRIPTION OF THE INVENTION

Figure 3:
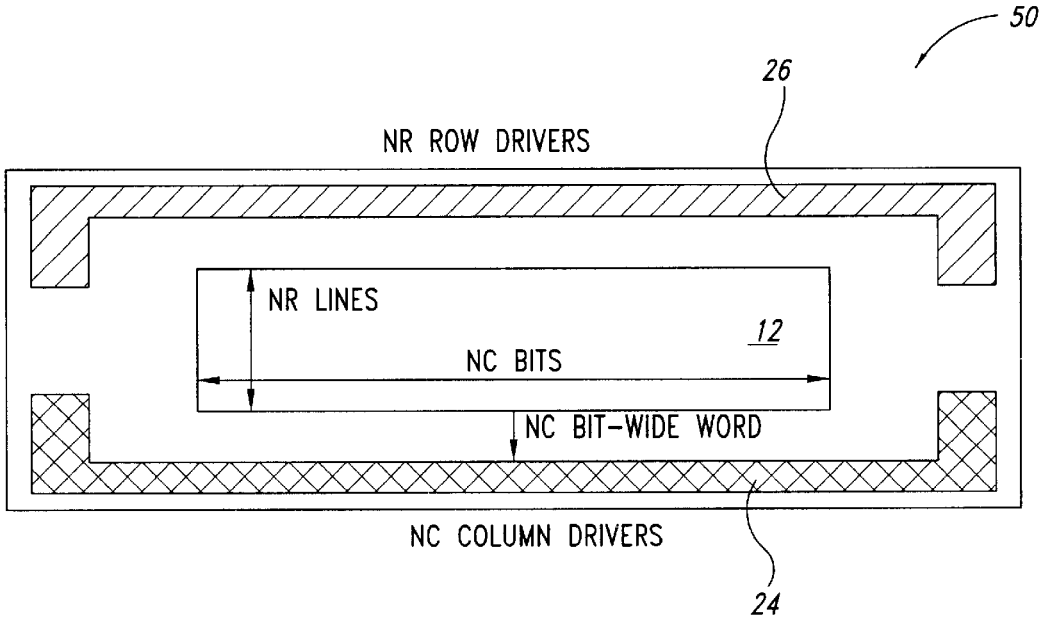
Fig. 3 (Prior Art)
FIG. 3 is a diagram illustrating components of the controller of FIG. 2.
Figure 5:
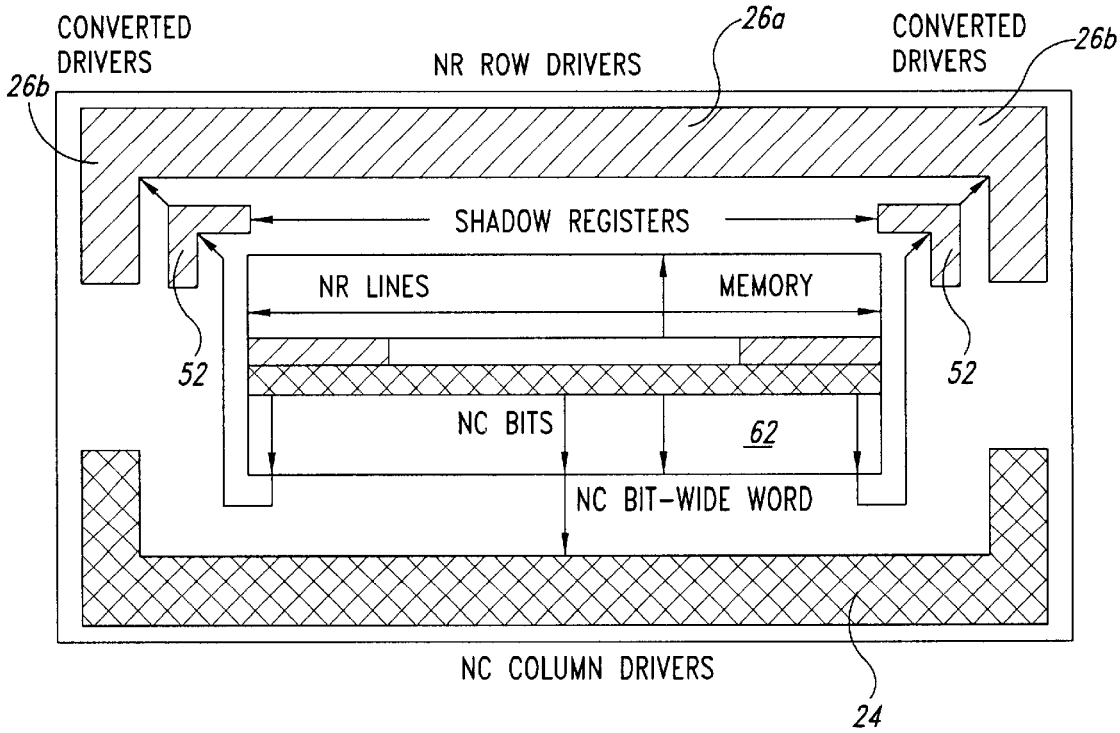
FIG. 5 is a diagram showing components used in a folded memory architecture according to the invention.

Portions of an LCD controller 50 according to the invention are shown in FIG. 5. The column drivers 24 appear as they did in the earlier circuit shown in FIG. 3, as well as the row drivers 26*a* and converted "row" drivers 26*b*, which actually are used to drive additional columns.

Additionally, the LCD controller 50 includes a set of shadow registers 52, shown near the converted row drivers 26*b*.

Any data from a new logical row that exceeds a physical row will be stored in the shadow registers for one clock cycle prior to being loaded into the converted drivers 26*b*, as discussed below.

Figure 1:
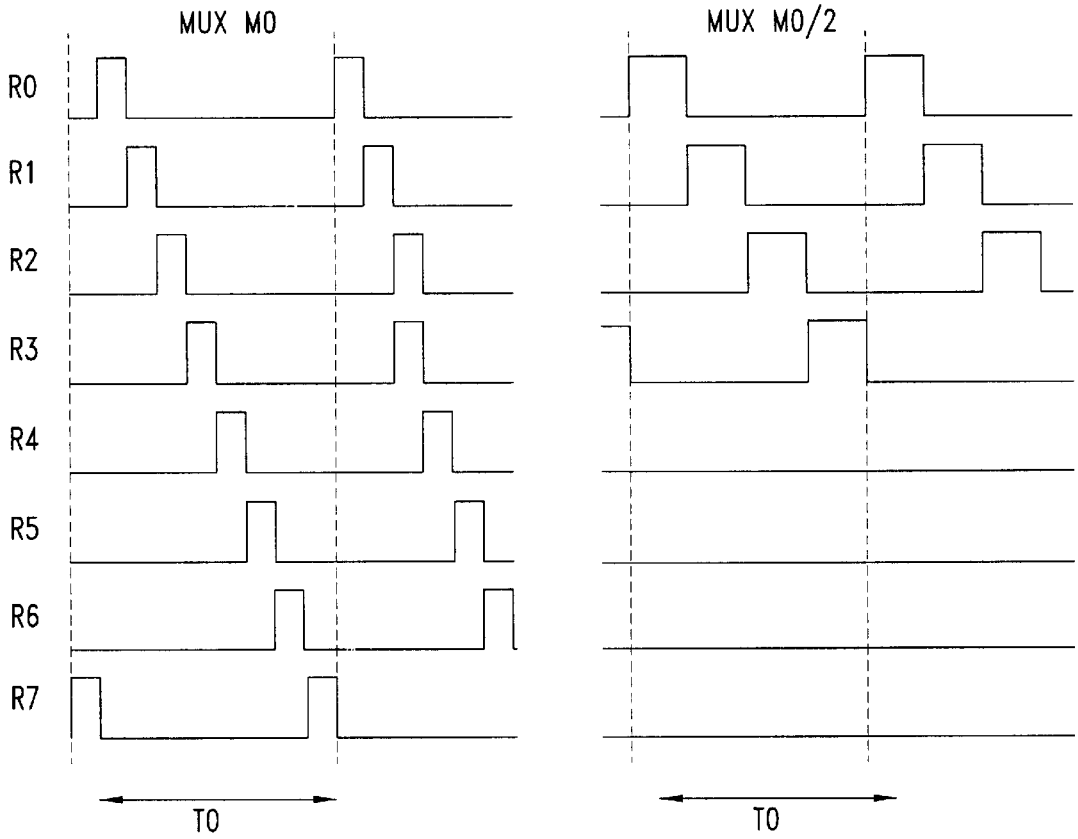
Fig. 1 (Prior Art)
FIG. 1 is a timing diagram illustrating waveforms associated with LCD rows addressing.
Figure 2:
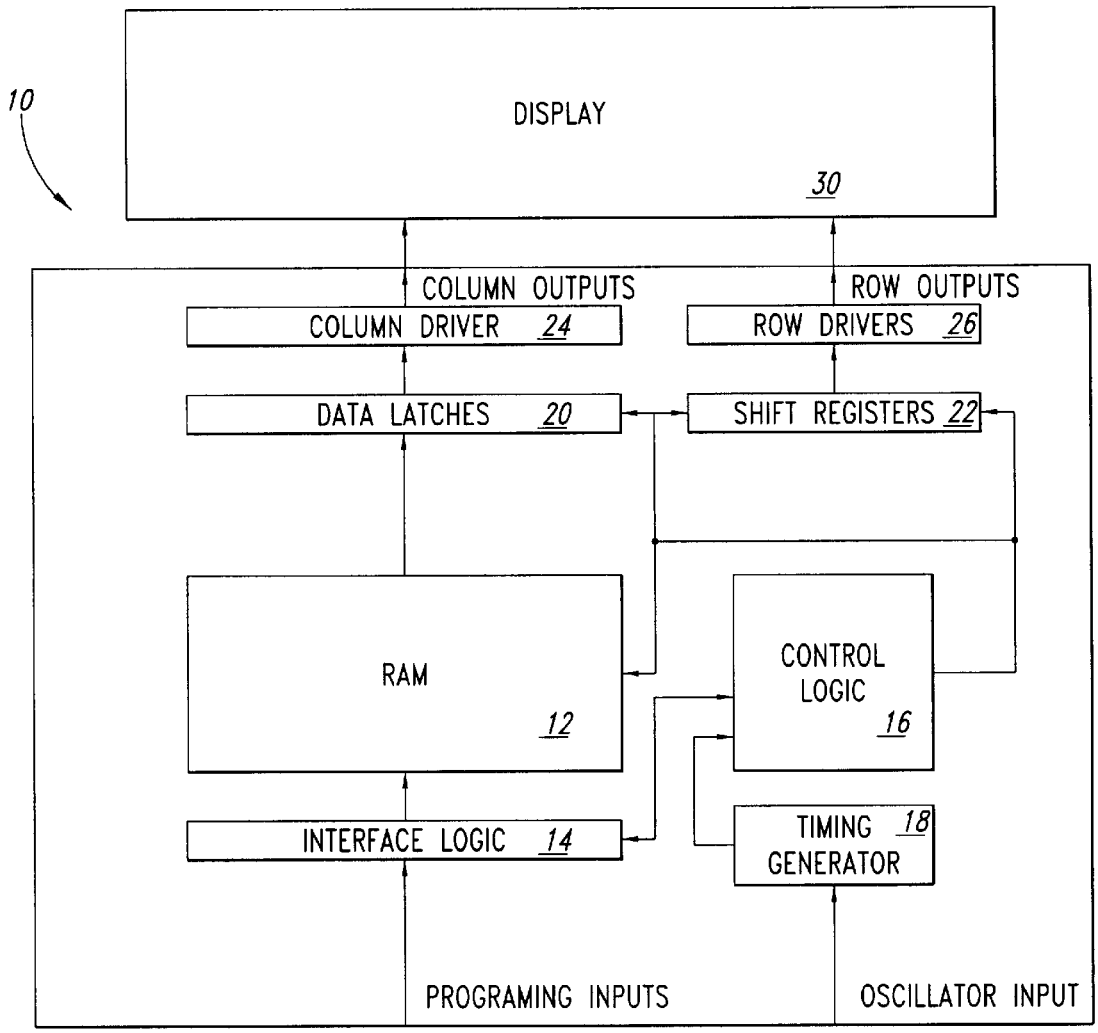
Fig. 2 (Prior Art)
FIG. 2 is a block diagram illustrating typical LCD controller components.
Figure 4:
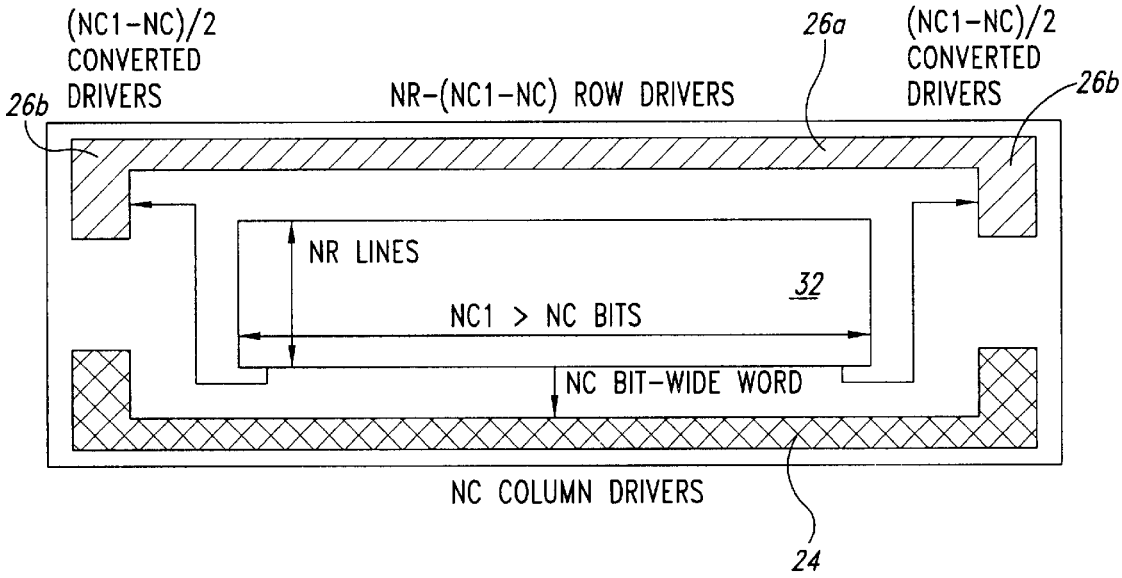
Fig. 4 (Prior Art)
FIG. 4 is a diagram illustrating the components of FIG. 3 in an alternative configuration.
Figure 6A:
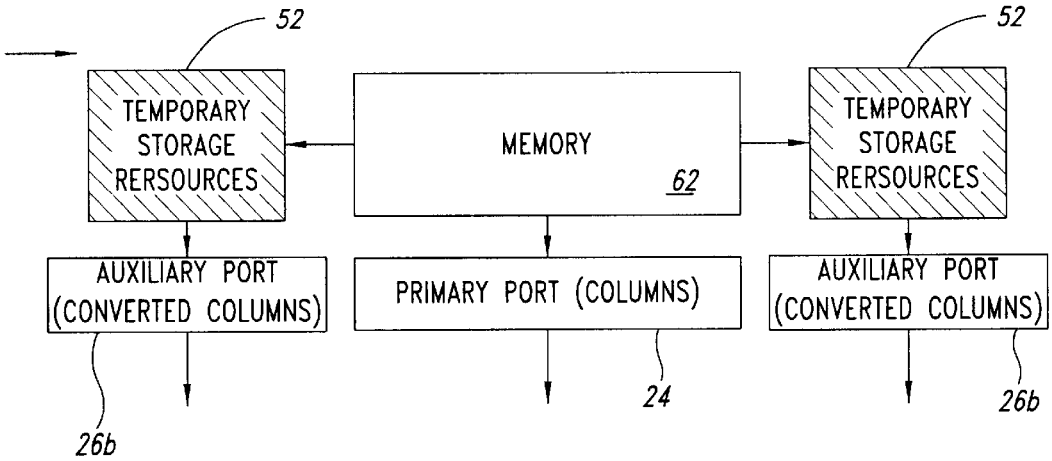
FIGS. 6*a* and 6*b* are a block diagram showing components used in a folded memory architecture according to the invention.
Figure 6B:
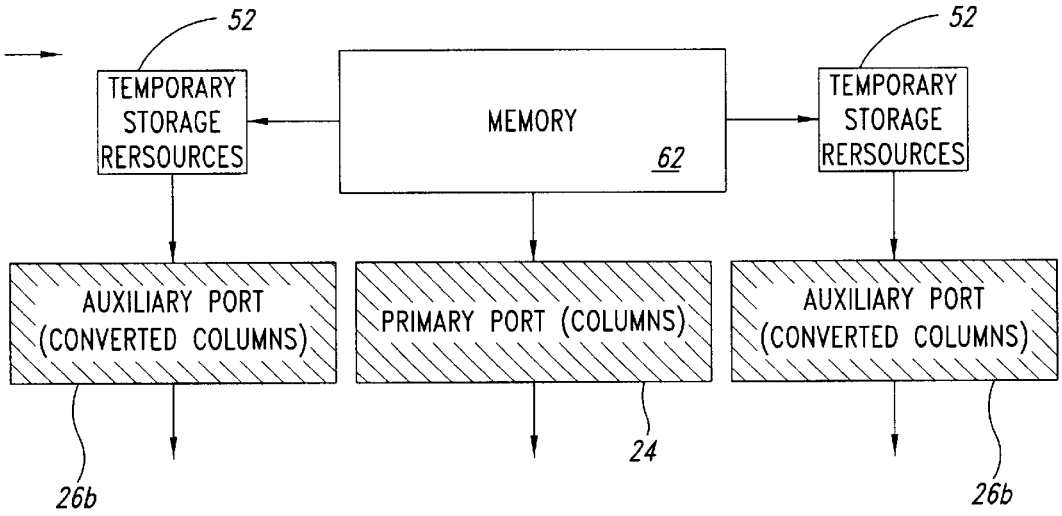

With reference to FIGS. 6*a* and 6*b*, a block diagram showing some of these components is shown. A RAM memory 62, which can be SRAM, or any suitable RAM is shown. The memory 62 is similar to the memory 12 shown in FIG. 2, but has some meaningful differences, discussed below. It is noteworthy that the memory 62 uses the standard NC number of bits per row, rather than the NC1 bits per row used in the prior art memory 32 of FIG. 4. Thus, the inventive method can be used with standard memory module sizes. Directly coupled to the memory 62 are the shadow registers 52, as well as the column drivers 24. Note that the converted drivers 26*b* are not directly connected to the 62, as was the case in the prior art shown in FIG. 4.

In FIG. 6*a*, a first timing signal is received and the memory 62 loads data that will eventually be sent to the converted drivers 26*b* into the shadow registers 52. Data being written into the shadow registers 52 is denoted by shading. The first timing signal is a slave signal, which will be explained further below.

In FIG. 6*b*, a second timing signal is received and the memory 62 loads data into the column drivers 24, only. At the same time the second timing signal is received, the shadow registers 52 load the data previously stored in them into the converted drivers 26*b*. The data from the column drivers 24 and the converted drivers 26*b* is used to drive the LCD display 30.

The inventive architecture does not change the system clock frequency, other than the information throughput towards the LCD display scales down according to the multiplex ratio programmed.

Figure 7A:
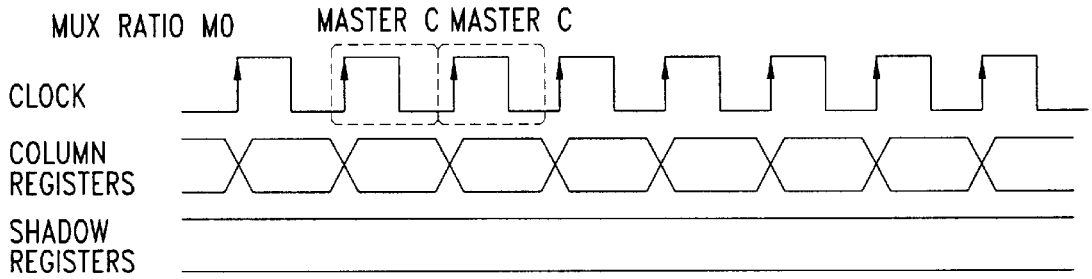
FIGS. 7*a*, 7*b*, and 7*c* are timing diagrams showing different signals in the inventive LCD controller in various configurations.
Figure 7B:
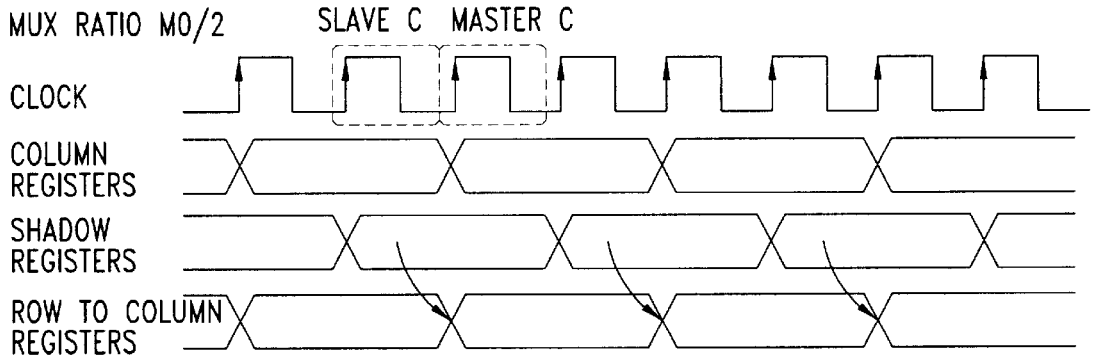
Figure 7C:
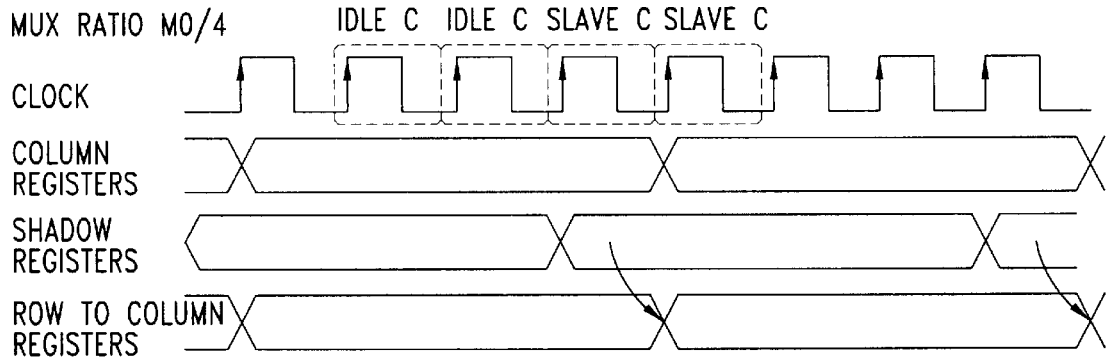

With reference to FIGS. 7*a*, 7*b* and 7*c*, three separate timing diagrams are shown of the operation of the inventive device, each for different multiplex ratios. The first timing diagram in FIG. 7*a* is for a standard multiplex ratio, where $\propto=1$, i.e., no folding of the memory 62 takes place. The other two timing diagrams show multiplex ratios of M0/2 and M0/4, where folding does take place, in FIGS. 7*b* and 7*c*, respectively.

In FIG. 7*a*, where no folding of the memory 62 takes place, the clock strobes normally, as in the prior art. For each master clock cycle (denoted Master C), the column drivers 24 are updated as in normal operation. Because no information is being stored in the shadow registers 52, they need not be updated, and therefore are never strobed.

In FIG. 7*b*, where the multiplex ratio is M0/2, a slave clock cycle (denoted Slave C) alternates with the master clock cycle. During the slave clock cycle, the shadow registers 52 are updated while the column registers 24 remain unchanged. This corresponds to the action shown in FIG. 6*a*. Then, during the master clock cycle, both the column drivers 24, and the converted drivers 26*b* will be updated at the same time, with the memory 62 updating the column drivers 24, and the shadow registers 52 updating the converted drivers 26*b*. This is shown in FIG. 6*b*. All of the column drivers 24 and the converted drivers 26*b* output their data at the same time, which is during the master clock cycle. During this same master clock cycle, the shadow registers 52 remain unchanged.

FIG. 7*c* has the same operations as FIG. 7*b*, and works the same was as depicted in FIGS. 6*a* and 6*b*. The difference between FIGS. 7*b* and 7*c* is that in FIG. 7*c* there are two extra clock cycles that are unneeded and therefore the memory 62 sits idle. In this way, during the idle cycles, the row and column drivers 24, 26 and the shadow registers 52 remain unchanged.

When used, the shadow registers 52 always are updated with the same frequency as the column drivers 24, and converted drivers 26*b*, but the shadow registers are always updated one clock cycle earlier.

Figure 8:
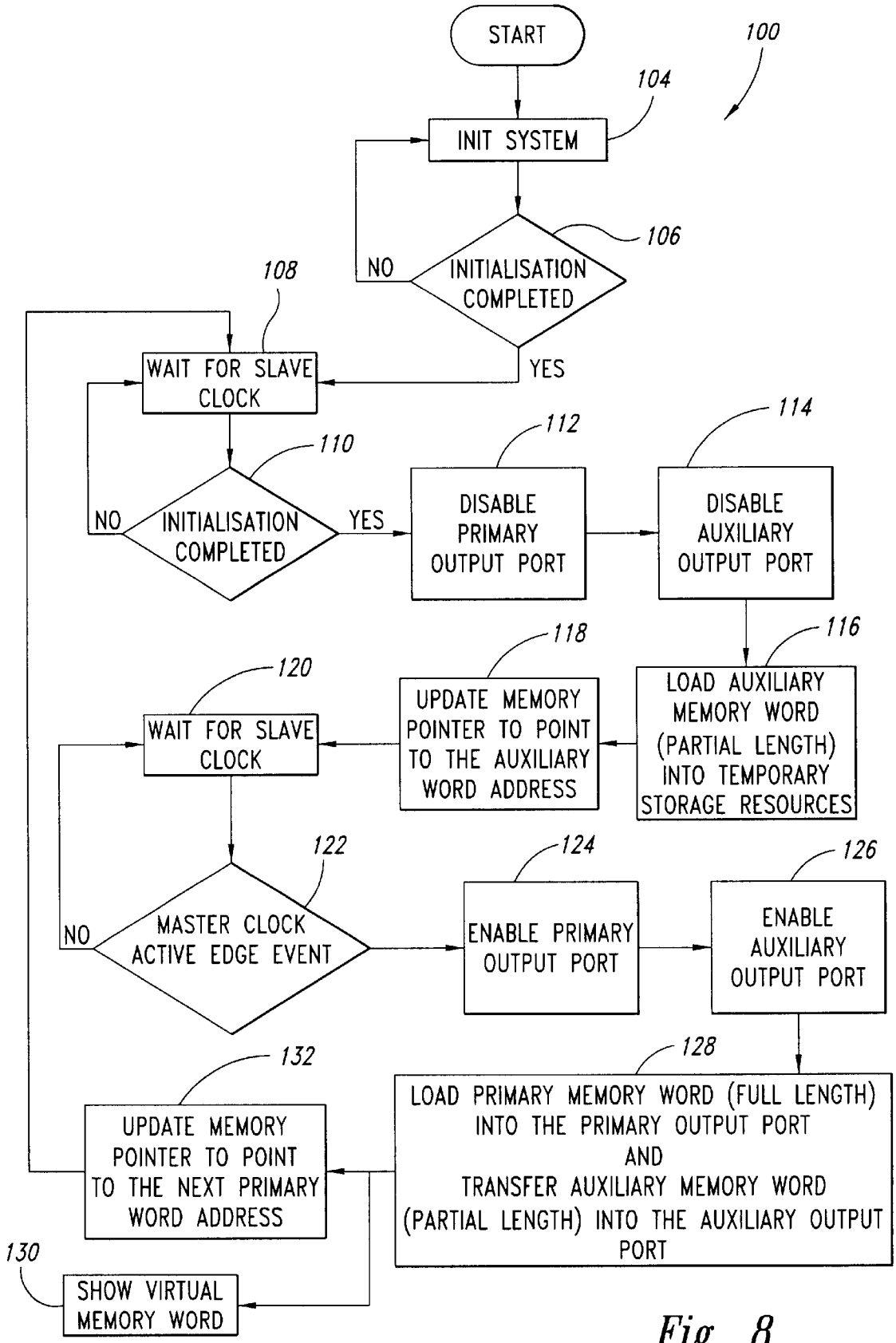
FIG. 8 is a flowchart showing features of the method according to the invention.

A flowchart showing the operations of the inventive control circuit is shown in FIG. 8. In that Figure, a system 100 begins at a start block 102. An initialization takes place at a step 104 and a check is made in a step 106 until the initialization is complete.

After the system 100 is initialized, it goes to a state 108 to check for the slave clock signal, which was shown in FIGS. 7*b* and 7*c*. A check for the slave signal is made in a step 110. When the slave clock signal is received at a step 112, the memory 62 disables its primary output port, which are the column drivers 24. In a step 114, the memory 62 disables its auxiliary output port, which are the converted columns 26*b*.

In a step 116, an auxiliary memory word is loaded into the shadow registers 52. This corresponds to what was shown in FIG. 6*a*. Next, the memory 62 updates a pointer to point to the address of the auxiliary word in a step 118.

A step 120 checks for a master clock signal and a step 122 waits until the master clock signal is received. Once the master clock signal is received in step 122, the primary and auxiliary output ports of the memory 62 are enabled in steps 124 and 126, respectively.

Next, in a step 128 the memory 62 loads the primary memory word into the primary output port, which are the column drivers 24. The memory 62 also directs the shadow registers 52 to transfer their contents into the converted drivers 26*b*. This corresponds to what was shown in FIG. 6*b*.

In a step 130, the virtual memory word stored in the converted drivers 26*b* and the column drivers 24 is directed to the LCD display 30 and is displayed. Simultaneously, a memory pointer in the memory 62 is updated to point to the next primary word address.

For each multiplex ratio$\leqq\propto$*NR ($\propto=2^{-k}$, where k is an integer>0) the inventive solution allows the memory cells in the memory 62 to be efficiently used, so that up to 2*NC columns can be driven, if there are no other limitations, for instance too few pads, wiring issues, etc.

The range of possible solutions with whatever multiplexed configuration is selected have a number of usable columns bounded to:

$$(\text{Available Pins}-\text{Row Pins used})=(NC+NR)-NRU \tag{2}$$

where NC=number of columns in the standard configuration ($\propto=1$);

NR=number of rows in the standard configuration; and

NRU=number of rows used in the extended configuration NRU ($\propto\leqq0.5$).

If a memory row is accessed with full parallelism, i. e., if a memory row read operation that issues NC bits at a time can be accomplished in only one clock cycle, then $NRU_{max}$ cannot be larger than NC/2 because to generate one virtual memory row, two physical rows are needed that are sequentially accessed.

Using this method, the physical memory shape factor of NC/NR can be virtually shaped anywhere from:

$$(NC+NR-NRU_{max})/NRU_{max} \tag{3}$$

$$\text{to } (NC+NR-NRU_{min})/NRU_{min} \tag{4}$$

where $NRU_{max}$ is NC/2, and $NRU_{min}$ is the minimum number of rows allowed.

Equations 3 and 4 provide the lower and upper limit of the virtual shape of the memory.

As an example, if NC=128 and NR=64, and the minimum number of rows is 8, then the shape factor spreads from, using equations (3) and (4), 128/64 to 184/8.

Then, substituting these numbers into the memory use efficiency equation (1), a memory use range is established from $$((NC+NR-NRU_{max})*(NRU_{max}))/((NC)*(NR)) \tag{5}$$

$$\text{to } ((NC+NR-NRU_{min})*(NRU_{min}))/((NC)*(NR)) \tag{6}$$

Substituting the same figures as above, NC=128, NR=64, $NRU_{max}$=NC/2 and $NRU_{min}$=8, then equations (5) and (6) yield efficiency values from:

$$1(@\ NRU=64)>\text{efficiency}>0.18(@NRU=8) \tag{7}$$

If no folding mechanism was used, and the minimum 8 LCD rows were accessed, the memory use efficiency, substituting the values into equation (1) yields:

$$(128*8)/(128*64)=0.126 \tag{8}$$

Thus, using the inventive folding technique, when only 8 LCD rows are accessed, the efficiency rises from 0.126 to 0.18, a 30% increase.

FIGS. 9*a* and 9*b* show a mathematical plot of how much memory can be saved by using the inventive folding technique over the standard non-folding technique.

FIG. 9*a* is a graph showing the savings when the number of rows equals the number of columns, or NR=NC. FIG. 9*b* is a similar graph, but shows the savings when NC=2NR, or when there are twice as many columns as rows.

Important features on these graphs are η0, η1, and η2, which show the relationship of used memory to available memory when using the folding technique (η1, η2), and when not using the folding technique (η0). Note how in both cases (FIGS. 9*a* and 9*b*) more of the otherwise unused memory cells in the memory array can be used by the LCD controller if the inventive folding technique is utilized.

Derivation of the plotted function η begins at equation (1) above, and proceeds as follows:

Step 1 (Used memory)/(Available memory)

(beginning equation 1, above)

Step 2 (Available Columns*used Rows)/(Std. Cols*Std. Rows)

(used memory is the number of rows used multiplied by the number of columns in each row; available memory is the number of standard columns multiplied by the standard number of rows)

Step 3 ((Available pins−used rows)*used rows)/(NC*NR)

(the number of available columns is the total available pins, less those pins that are used for the rows. NC is the standard number of columns and NR is the standard number of rows, as noted in the text above)

Step 4 (((NC+NR)−NRU)*NRU)/(NC*NR)

(in the standard memory, there is one pin for each column (NC) and each row (NR). NRU is the number of rows used, as noted in the text above)

Step 5 ((NC/NR)+(NR/NR)−(NRU/NR))*(NRU/NR)/(NC/NR)

(dividing both the numerator and the denominator of Step 4 by (NR*NR)

Step 6 ((NC/NR)+1−∝)*∝*(NR/NC)

(introduce ∝=(NRU/NR), invert and divide.

Step 7 (NR/NC)*((NC/NR)+1−∝)*∝

(other manipulations)

Step 8 (1+(NR/NC)−∝*(NR/NC))

(simplify ∝)

Step 9 ∝+∝(1−∝)(NR/NC)==η(∝; (NR/NC))

(as shown in FIGS. 9*a* and 9*b*)

Then η was plotted for different values of NR/NC at FIGS. 9*a* and 9*b*, with η0 plotted when folding was not used and η1 and η2 plotted when folding was used. As is seen in these Figures, using the folding method allows memory cells that would have otherwise been wasted or unused, to be "reclaimed" and used by this process.

Therefore, by using this new technique, much higher memory usage rates can be attained than by using conventional techniques. This allows greater flexibility for producing output on the LCD display 30, and can ultimately make a more useful device than by using conventional methods.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

What is claimed is:

1. A memory controller for a display comprising:

a set of first drivers;

a set of second drivers, a portion of which can be converted to said first drivers;

a RAM memory structured to accept data at an input and output said data to the sets of first and second drivers when a master clock signal is received at said RAM memory;

a clock signal generator structured to generate said master clock signal;

a control signal generator circuit structured to generate control signals for said RAM memory and said sets of first and second drivers; said clock signal generator circuit is structured to also generate a slave clock signal; and;

a set of auxiliary registers structured to temporarily store a first portion of said data received from said RAM memory after receiving said slave clock signal, and said set of auxiliary registers structured to output said first portion of data into said portion of said second drivers converted to said set of first drivers after receiving said master clock signal.

2. The memory controller of claim 1 wherein said set of first drivers stores NC data bits in a standard configuration, and wherein the set of auxiliary registers comprises two auxiliary registers, each storing ½ of up to NC/2 pieces of data.

3. The memory controller of claim 1 wherein said RAM memory is made of SRAM cells.

4. The memory controller of claim 1 wherein said clock signal generator is programmable to vary the cycle time and period of said master and slave clock signals.

5. The memory controller of claim 1 wherein prior to said set of auxiliary registers storing said first portion of said data, said control signal generator is configured to issue a control signal to disable a primary system port and enable a secondary system port, both of said ports coupled to said RAM memory.

6. The memory controller of claim 5 wherein said control signal generator issues said control signal after said slave signal is received.

7. The memory controller of claim 1 wherein the display is a liquid crystal display.

8. A method of using folded memory addressing in a liquid crystal display controller having a RAM memory, first and second sets of drivers, and a clock signal generator capable of generating clock signals, the method comprising:

converting a portion of the second set of drivers to said first set of drivers;

after a storing clock signal is received, storing data from said RAM memory into said first set of drivers and the converted set of said second drivers; and transferring the data stored in said first set and converted set of drivers into the liquid crystal display, and temporarily storing the data to be stored into said converted set of drivers into an auxiliary memory prior to transferring said data stored in said RAM memory into said first set of drivers.

9. The method of claim 8 characterized in that it further comprising the steps of:

generating a pre-storing clock signal in the clock signal generator and providing it to said RAM memory;

after said pre-storing clock signal is received in said RAM memory, disabling a primary system port coupled to said RAM memory that feeds into said first set of drivers, enabling a secondary system port coupled to said RAM memory that feeds into said auxiliary memory, and updating a memory pointer to point to an auxiliary word address after temporarily storing the data to be stored into said converted set of drivers into said auxiliary memory.

10. The method of claim 8, further comprising:

after said storing clock signal is received at said RAM memory, disabling said secondary system port, and enabling said primary system port.

11. The method of claim 10, further comprising:

after said storing clock signal is received at said RAM memory, storing data from said RAM memory into said first set of drivers, and directing said auxiliary memory to store the data stored in said auxiliary memory to said converted set of drivers.

12. The method of claim 11, comprising:

after the final data is stored in said first set of drivers and said converted set of drivers, displaying the final data on the liquid crystal display.

13. A memory controller for a display, comprising:

a set of auxiliary registers configured to temporarily store a first portion of data received from a RAM memory upon receipt of a slave clock signal, the set of auxiliary registers further configured to output the first portion of data into a portion of a second set of drivers converted to a first set of drivers after receiving a master clock signal.

14. A memory controller for a display, comprising:

a clock signal generator configured to generate a master clock signal and a slave clock signal;

a RAM memory configured to accept data at an input and to output data upon receipt of the master clock signal; and a set of auxiliary registers configured to temporarily store a first portion of the data output from the RAM memory after receiving the slave clock signal, the set of auxiliary registers further configured to output the first portion of data into a portion of a second set of drivers that are converted to a first set of drivers after receiving the master clock signal.

15. A memory controller for a display, comprising:

a first set of drivers;

a second set of drivers, the second set of drivers including a portion of which can be converted to the first set of drivers;

a clock signal generator configured to generate a master clock signal and a slave clock signal;

a RAM memory configured to accept data at an input and to output the data to the first and second sets of drivers when the master clock signal is received at the RAM memory; and a set of auxiliary registers configured to temporarily store a first portion of the data output from the RAM memory after the set of auxiliary registers receives the slave clock signal, the set of auxiliary registers further configured to output the first portion of data into a portion of the second set of drivers that are converted to the first set of drivers after the set of auxiliary registers receives the master clock signal.

16. A memory controller for a display, comprising:

a first set of drivers;

a second set of drivers, the second set of drivers including a portion of which can be converted to the first set of drivers;

a clock signal generator configured to generate a master clock signal and a slave clock signal;

a RAM memory configured to accept data at an input and to output the data to the first and second sets of drivers when the master clock signal is received at the RAM memory;

a control signal generator circuit configured to generate control signals for the RAM memory and the first and second sets of drivers; and a set of auxiliary registers configured to temporarily store a first portion of the data output from the RAM memory upon receipt of the slave clock signal, the set of auxiliary registers further configured to output the first portion of data into a portion of the second set of drivers that is converted to the first set of drivers when the set of auxiliary registers receives the master clock signal.

17. The memory controller of claim 16, wherein the RAM memory comprises a primary system port and a secondary system port, and further wherein the control signal generator is configured to issue a control signal to disable the primary system port and to enable the secondary system port of the RAM memory prior to the set of auxiliary registers storing the first portion of the data.

18. A method of using a folded memory address in a liquid crystal display controller having a RAM memory, first and second sets of drivers, and a clock signal generator configured to generate a storing clock signal and a pre-storing clock signal, the method comprising:

converting a portion of the second set of drivers to the first set of drivers;

generating the pre-storing clock signal in the clock signal generator and providing it to the RAM memory;

disabling a primary system port coupled to the RAM memory that feeds into the first set of drivers;

enabling a secondary system port coupled to the RAM memory that feeds into an auxiliary memory; generating the storing clock signal and providing it to the RAM memory;

storing data from the RAM memory into the first set of drivers and the converted portion of the second set of drivers; and transferring the data stored in the first set of drivers and the converted set of drivers into the liquid crystal display and temporarily storing the data to be stored into the converted set of drivers into an auxiliary memory prior to transferring the data stored in the RAM memory into the first set of drivers, and updating a memory pointer to point to an auxiliary word address after temporarily storing the data to be stored the converted set of drivers into the auxiliary memory.

* * * * *